United States Patent [19]

Tanaka et al.

[11] 4,136,271

[45] Jan. 23, 1979

[54] MICROWAVE OVEN

[75] Inventors: Junzo Tanaka, Fujiidera; Chikao Urashima, Nara, both of Japan

[73] Assignee: Matsushita Electric Industrial Co., Ltd., Kadoma, Japan

[21] Appl. No.: 763,120

[22] Filed: Jan. 27, 1977

[30] Foreign Application Priority Data

| | | | |
|---|---|---|---|
| Feb. 4, 1976 | [JP] | Japan | 51-11541 |
| Feb. 3, 1976 | [JP] | Japan | 51-11536[U] |
| Feb. 5, 1976 | [JP] | Japan | 51-12656[U] |

[51] Int. Cl.[2] ..... H05B 9/06

[52] U.S. Cl. ..... 219/10.55 F

[58] Field of Search ..... 219/10.55 A, 10.55 R, 219/10.55 F, 10.55 E, 10.55 D

[56] References Cited

U.S. PATENT DOCUMENTS

| | | | |
|---|---|---|---|
| Re. 28,888 | 6/1976 | Mori | 219/10.55 E |
| 2,632,090 | 3/1953 | Revercomb et al. | 219/10.55 F |
| 2,632,838 | 3/1953 | Shroeder | 219/10.55 D |
| 3,439,144 | 4/1969 | Boswell et al. | 219/10.55 F |
| 3,943,318 | 3/1976 | Hirai | 219/10.55 D |
| 4,019,010 | 4/1977 | Tanaka et al. | 219/10.55 F |

*Primary Examiner*—J. V. Truhe
*Assistant Examiner*—Bernard Roskoski
*Attorney, Agent, or Firm*—Wenderoth, Lind & Ponack

[57] ABSTRACT

A microwave oven equipped with a rotary table for placing food material to be cooked thereon in which the rotational center of the rotary table within the heating chamber is offset toward the rear wall of the heating chamber from the central portion of the distance between the inner surface of the door and the rear wall of the heating chamber, that distance being larger than the inner width of the heating cavity for preventing the danger of electric wave leakage resulting from breakage of a shielding plate and its reinforcement in the oven door due to contact of the food material or a spit carrying the food material with such reinforcement and resultant spark discharge.

2 Claims, 8 Drawing Figures

MICROWAVE OVEN

Figure 1:
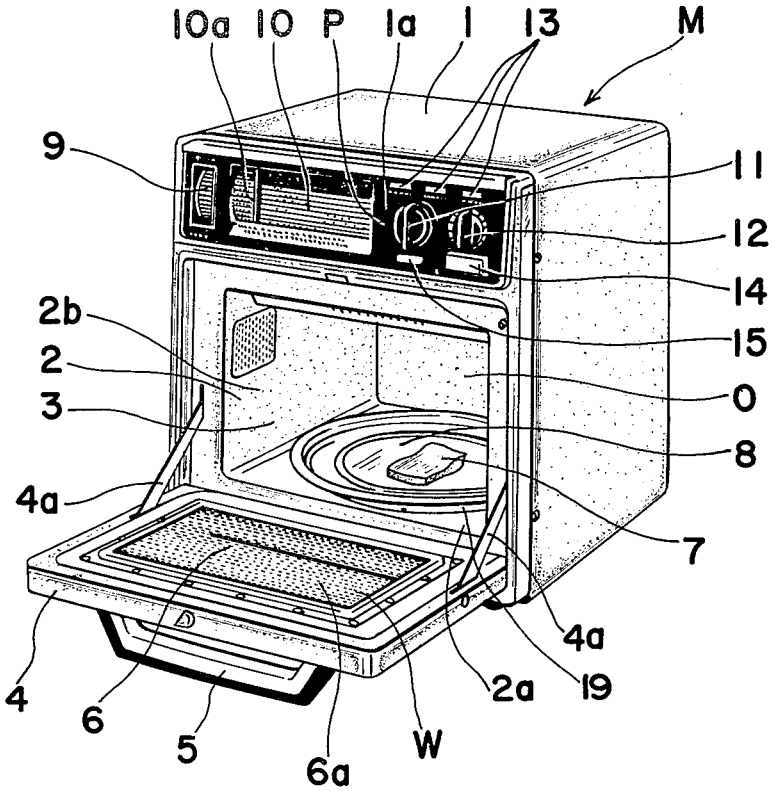

The present invention relates to a high frequency heating apparatus and more particularly, to a microwave oven or an electronic oven utilizing high frequency for cooking food material disposed therein.

A high frequency heating apparatus or microwave oven which is now widely used essentially includes an oven-defining structure preferably of double wall construction provided therein with a heating cavity having a hingedly supported door which is adapted to selectively open and close an access opening formed at one side of the oven defining structure, and a magnetron assembly for generating high frequency energy for heating the object or food material placed within the heating cavity.

Generally, in high frequency heating or cooking apparatuses wherein the food material is heated based on the principle of dielectric heating, the tendency to irregular or uneven heating is small as compared with that in cooking apparatuses of other kinds, since the object or food material to be heated is caused to generate heat within itself. Nevertheless, it is still difficult to avoid the presence of strong and weak portions of the electric field within the heating cavity more or less, and even when a plurality of objects to be heated are of the same material, there is a certain difference in the degree of heating between those placed in the strong portion of the electric field and those placed in the weak portion of the electric field within the heating cavity. Such a tendency not only makes it difficult to estimate the time required for the cooking, but also results in serious incoveniences in that some objects are overheated, while others still remain insufficiently heated, especially when more than two objects are to be heated simultaneously for cooking.

In order to overcome the disadvantages as described above, there have conventionally been proposed two methods in general, one of which is the provision of a rotatable metallic member known as stirrer fan for reflecting and stirring electric waves to relieve the undesirable irregular distribution of the electric field within the heating cavity, and the other of which is to dispose a rotary table within the heating cavity for rotation together with the objects mounted thereon, so that the degree of heating of such objects is made uniform by causing them to move within the heating cavity of the microwave oven.

Although the employment of the rotary table of the above described type is very advantageous from the viewpoint of readily achieving the uniform heating, because of its simplicity in principle and design, there is a serious problem caused by electrical discharge involved in the above arrangement as described hereinbelow. More specifically, in the above arrangement employing the rotary table, especially when a metallic wire member such as a metallic spit or skewer is employed for spitting the food material to be heated, for example, during barbecue cooking, such a spit mounted on the rotary table together with the food material tends to be brought extremely close to or contact walls defining the heating cavity or inner surface of the door for the heating cavity so as to generate intensive electrical sparks therebetween during rotation of the rotary table. Particularly, the door is provided with an observation window for permitting the object to be readily observed therethrough during cooking, which observation window has a punched metal sheet or wire netting fitted therein as a see-through shielding plate member for preventing leakage of electric waves, and it has been a recent trend to employ such a shielding plate member having an increased aperture opening for better see-through clarity and convenience during use, with the strength of the shielding plate member inevitably being reduced as a consequence. Accordingly, it is a common practice to dispose transparent plate members of glass or resinous material along opposite surfaces of the shielding plate member for reinforcement by holding the punched metal sheet or wire netting between the transparent plate members. Such an arrangement, however, presents another serious problem in that breakage or damage to the glass or resinous plate members and consequently to the shielding plate member by the sparks as described above directly results in an accident accompanied by leakage of electric waves from the heating cavity. Especially when such plate members are of glass material, the reinforced glass is generally employed to withstand impacts from outside, which reinforced glass, however, has a property such that if a part of its surface is caused to melt to form an opening therein by the generation of the above described sparks, stress distribution in the reinforced glass causes the glass to fracture and cracks centered at the melted part are developed through the entire glass plate to break the same, thus resulting in danger such as the leakage of electric waves. Therefore, in a high frequency cooking apparatus equipped with a rotary table, it is a matter of great importance to provide effective means for preventing the spit or object to be heated from coming excessively close to or contacting the inner surface of the door during heating.

Accordingly, an essential object of the present invention is to provide a microwave oven equipped with a rotary table in which possible contact of an object to be heated or a spit for that object with an inner surface of a door for the oven is prevented for the elimination of spark discharge therebetween.

Another important object of the present invention is to provide a microwave oven of the above described type in which positioning of the object to be heated or the spit therefor on the rotary table in the heating cavity is facilitated so as to prevent to close an approach or possible contact with an accompanying spark discharge between the inner surface of the door and the object to be heated or a spit therefor.

A further object of the present invention is to provide a microwave oven of the above described type in which distribution of heating strength in the heating cavity is further improved, with simultaneous efficient use of the space within the heating cavity.

In accomplishing these objects, according to one preferred embodiment of the present invention, the microwave oven equipped with a rotary table for placing an object to be heated thereon has the rotational center of the rotary table within the heating cavity offset toward the rear wall of the heating cavity from a central portion of the distance between the inner surface of the door and the rear wall of the heating cavity, with said distance being larger than the inner width of the heating cavity. Accordingly, the spit or the like for the object placed on the rotary table and likely to contact the inner surface of the door is first brought into contact with the rear wall of the heating cavity so as to be positionally restricted as the rotary table is rotated during heating, thus being positively prevented from contacting or approaching too close to the inner surface of the door, and thus a microwave oven having superior safety characteristics and free from danger of high frequency leakage due to breakage of the transparent plate member and the metallic shielding member is advantageously provided, with substantial elimination of the disadvantages inherent in the conventional microwave ovens.

Figure 2:
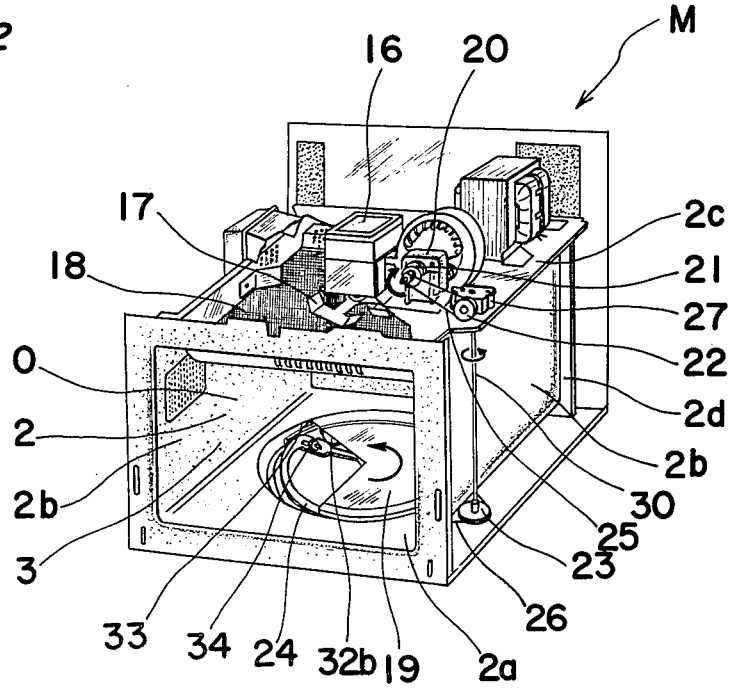
Figure 3:
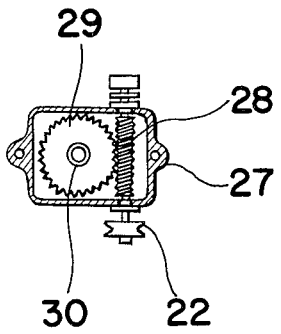
Figure 4:
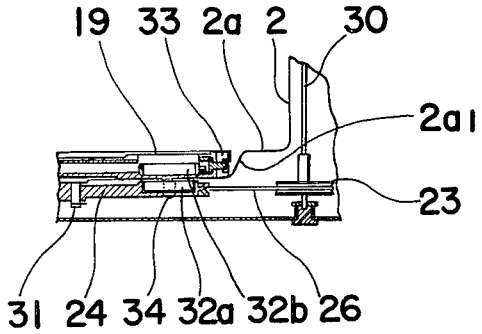
Figure 5:
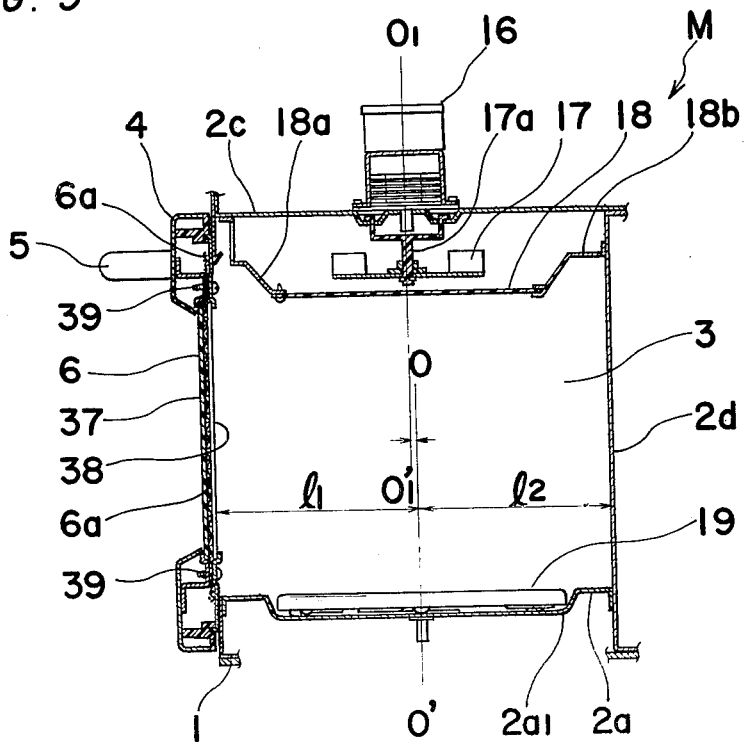
Figure 6:
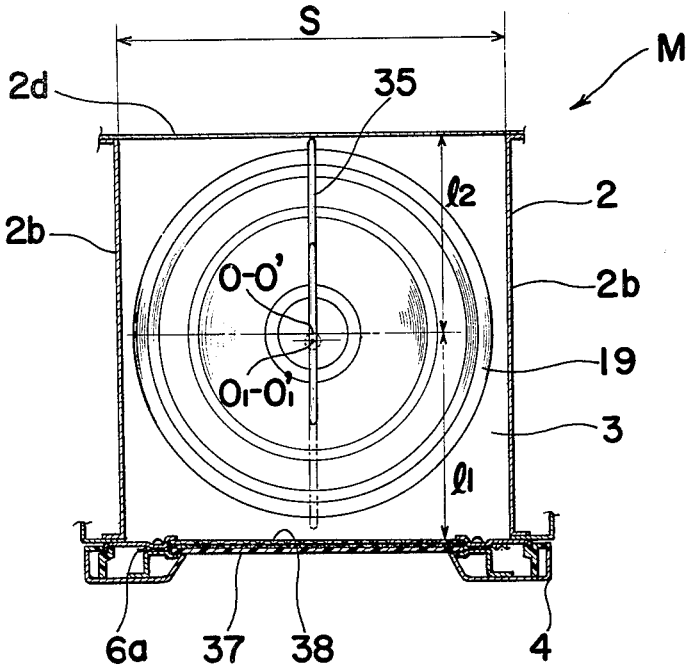
Figure 7:
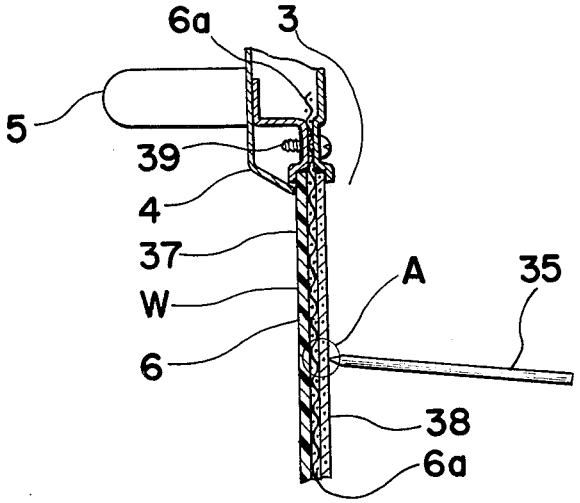
Figure 8:
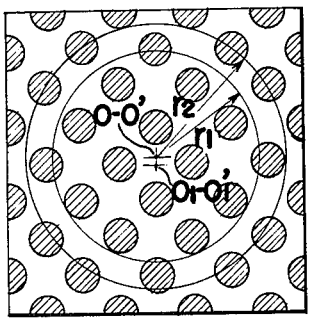

These and other objects and features of the present invention will become apparent from the following description taken in conjunction with the preferred embodiment thereof with reference to the attached drawings, in which;

FIG. 1 is a perspective view of a microwave oven to which the present invention is applicable, with the door thereof in an opened state, FIG. 2 is a view similar to FIG. 1 partly broken away, with the outer casing and the door thereof removed for clarity, FIG. 3 is a sectional top plan view showing, on an enlarged scale, a gear box employed in the microwave oven of FIG. 1 for driving a rotary table, FIG. 4 is a fragmentary sectional view showing, on an enlarged scale, the rotary table driving mechanism employed in the microwave oven of FIG. 1, FIG. 5 is a sectional side view of the microwave oven of FIG. 1 with the door thereof closed and the outer casing thereof broken away for clarity, FIG. 6 is a sectional top plan view of the microwave oven of FIG. 1, particularly showing relation between a spit mounted on the rotary table and the inner surface of the door, FIG. 7 is a fragmentary sectional view showing, on an enlarged scale, construction of an observation window of the door employed in the microwave oven of FIG. 1, and FIG. 8 is a top plan view showing distribution of heating strength on the rotary table within the heating cavity of the microwave oven of FIG. 1.

Before the description of the present invention proceeds, it is to be noted that like parts are designated by like reference numerals throughout the several views of the accompanying drawings.

Referring now to the drawings, there is shown in FIGS. 1 and 2 a microwave oven M which heat-treats objects or food material through utilization of high frequency energy, for example, on the order of approximately 2,450 MHZ and to which the present invention is applicable. The microwave oven M generally includes an outer casing 1 of cubical box-like configuration open at the front side thereof. The outer casing 1 forms a double wall structure together with inner walls 2 which are suitably made of electrically conductive weakly magnetizable material such as stainless steel and define a heating cavity or heating chamber 3, these inner walls 2 including a horizontal base plate 2*a*, vertical side walls 2*b*, a top wall 2*c* and a rear wall 2*d*, and thus defining an access opening O at the front of the oven M. In the heating cavity 3 immediately above the horizontal base plate 2*a*, there is rotatably disposed a rotary table 19 in a manner as described later, on which table 19, a vessel or dish 8 for placing the object 7 to be heated thereon is detachably mounted. The outer surfaces of the walls 2*a*, 2*b*, 2*c* and 2*d* are spaced from the corresponding walls of the outer casing 1 so as to provide spaces therebetween. The outer casing 1 further includes an outside front wall portion 1*a* immediately above the opening O. On the front wall portion 1*a*, there is mounted a control panel P which carries thereon a rotatable drum 10 having the heating time necessary for a plurality of menus imprinted on its peripheral surface, a pointer needle 10*a* for the drum 10, a drum rotating ring 9, timer operating knobs 11 and 12, indication lamps 13 each for indicating an output condition, a cooking start button 14 for initiating the high frequency heating, and a function indication lamp 15 which is illuminated during the high frequency heating. For setting the heating time for optimum cooking, the drum 10 is rotated by the ring 9 to find the heating time required for a particular food material to be cooked with which the pointer needle 10*a* is aligned by the timer operating knob 11. Meanwhile, heating at low output can be achieved through adjustment of the timer operating knob 12 or by rotation of the drum rotating ring 9 which is also connected to vary the output.

The microwave oven M further includes a door 4 provided with a handle 5 adjacent to one edge thereof remote from a hinge, by which hinge the door 4 is supported, at the lower edge thereof, on the lower front edge of the casing 1 in a position corresponding to the access opening O for pivotal upward and downward movements about the hinge so as to selectively open and close the opening O. The door 4 has a rectangular observation window W formed therein for permitting the object 7 placed in the heating cavity 3 to be observed therethrough and also for preventing the high frequency energy from leaking out of the heating cavity 3 during operation of the microwave oven M, the construction of which observation window W will be described more in detail later. The main casing 1 further includes an interior portion which provides means for slidingly accommodating a pair of door arms 4*a*, each of which is pivotally connected to a lower side portion of the door 4 and passes through a portion between the side wall of the casing 1 and the corresponding side wall 2*b* of the heating cavity 3.

Referring particularly to FIG. 2, in the space defined by the top wall of the casing 1 and the corresponding top wall 2*c* of the heating cavity 3, there is disposed, generally in the central portion of the wall 2*c*, a magnetron assembly 16 for radiating high frequency energy into the heating cavity 3, while a stirrer fan 17 which is rotatably supported by a shaft 17*a* (FIG. 5) suitably secured to the top wall 2*c* extends into the heating cavity 3. The stirrer fan 17 is adapted to rotate for stirring the high frequency energy in the cavity 3 by the air flow caused by blower means or a fan motor 20 disposed adjacent to the magnetron assembly 16 for cooling said magnetron assembly 16 and other electrical components thereabout. Immediately below the stirrer fan 17, a partition plate 18 is disposed in spaced relation to the fan 17 and in a direction parallel to the top wall 2*c*, which partition plate 18 is suitably connected at opposite edges thereof, to corresponding ends of shaped connectors 18*a* and 18*b* which are in turn secured at the other ends thereof to the top wall 2*c* and rear wall 2*d* of the heating cavity 3. The horizontal base plate 2*a* for the cavity 3 has therein a circular concave portion 2*a*1 (FIG. 5) at the central part thereof and is suitably connected to a front upwardly bent edge of the bottom plate of the outer casing 1 and the rear wall 2*d* of the heating cavity 3, with a space present between the bottom plate of the casing 1 and the base plate 2*a*. The rotary table 19 for detachably placing thereon the vessel 8 of non-metallic material and the object 7 to be heated is received in the concave portion 2*a*1 of the base plate 2a and is adapted to be driven by the fan motor 20 through a first pulley 21 secured to a shaft of the fan motor 20, a second pulley 22 secured to a lateral shaft extending from a gear box 27 which is fixed to the top wall 2c, a belt 25 passed around the pulleys 21 and 22, another shaft 30 extending downwardly from the gear box 27, a third pulley 23 secured to the lower end of the shaft 30, and another belt 26 associating the pulley 23 with the rotary table 19 in a manner described below.

Referring also to FIGS. 3 and 4, the rotational force of the fan motor 20 transmitted to the pulley 22 as described above is reduced in speed through a worm gear 28 secured to the same shaft as the pulley 22 and engaging a pinion 29 in the gear box 27, and is further transmitted to the pulley 23 through the shaft 30 for the pinion 29. Below the base plate 2a of the heating cavity 3, a fourth pulley 24 is rotatably supported by a pin 31 fixed at the central part of the concave portion 2a1 of the base plate 2a, while the belt 26 is directed around the pulleys 23 and 24 for driving the latter pulley 24. The rotary table 19 received in the concave portion 2a1 of the base plate 2a and the above described pulley 24 are respectively provided with corresponding magnet members 32a and 32b secured in positions adjacent to their peripheral edges, with the base plate 2a of the weakly magnetizable material for the heating cavity 3 disposed therebetween, and as the pulley 24 is rotated in the above described manner, the table 19 is also rotated through mutual attraction between the magnet members 32a and 32b. For smooth rotation of the table 19 and the pulley 24, roller members 33 and 34 contacting the base plate 2a are provided in positions close to the peripheral edges of the table 19 and the pulley 24. It should be noted that the rotary table 19 which contacts the bottom of the concave portion 2a1 of the base plate 2a only through the roller member 33 is readily detachable.

Referring particularly to FIGS. 5 and 6, in the microwave oven M according to the present invention, the distance l1 between the rotational center O-O' of the table 19 and the inner surface of the door 4 is larger than the distance l2 between the same rotational center O-O' and the rear wall 2d of the heating cavity 3, while the distance l1+l2 between the inner surface of the door 4 and the rear wall 2d of the heating cavity 3 is larger than the inner width S of the heating cavity 3.

In FIG. 7, the observation window W of the door 4 includes the rectangular opening 6 formed in the central portion of the door 4, in which opening 6, a see-through shielding plate member 6a, for example, of a punched metal sheet or wire netting is fitted for permitting the object 7 placed on the rotary table 19 to be observed therethrough and for preventing the high frequency energy from leaking out of the heating cavity 3, while the shielding plate member 6a is held between an inner transparent plate member 38, for example, of reinforced glass and an outer transparent plate member 37, for example, of resinous material which are also fitted into the opening 6 for reinforcement of the shielding plate member 6a and secured to frames of the door 4 by securing screws 39 as shown.

In the conventional microwave ovens, if a metallic spit or skewer 35 employed, for example, in barbecue cooking for spitting the object (not shown) should be brought extremely close to or into contact with the inner surface of the reinforced glass plate 38, for example, at a portion A on said glass plate 38 during heating as the rotary table 19 rotates, an intensive spark discharge continuously takes place between the spit 35 and the metallic shielding plate member 6a, and the portion A of the glass plate 38 is heated so as to become red hot and melt. The stress distribution in the glass plate 38 thus becomes unbalanced and cracks centering at the portion A develop over the entire surface of the glass plate 38.

In the microwave oven M of the present invention, the disadvantages in the conventional microwave ovens as described above are advantageously eliminated by making the distance l1 between the rotational center O-O' of the table 19 and the inner surface of the door 4 larger than the distance l2 between said rotational center O-O' and the rear wall 2d of the heating cavity 3 as described with reference to FIGS. 5 and 6 so that, even when an end of the spit 35 is likely to contact the inner surface, i.e., the reinforced glass plate 38 of the door 4, such an end of the split 35 first contacts the inner surface of the rear wall 2d for positional restriction of the spit 35 as the rotary table 19 rotates, and thus a microwave oven having superior safety characteristics well protected against accidents due to the leakage of electric waves from the heating cavity is provided. The arrangement as described above is also very effective for efficient use of the microwave oven, since the orientation and position of the spit 35 or the object 7 to be heated in the heating cavity 3 need not be considered so carefully as in the conventional microwave ovens.

Additionally, when the object 7 to be heated is inserted into the heating cavity 3, it is generally true that an operator intuitively senses the widthwise positional relation of the object 7 to the heating cavity 3 far more readily than the depthwise positional relation thereof, and tends to unconsciously compare the size and position of the object 7 and spit 35 with those of the heating cavity 3 with respect to the widthwise positional relation of the latter. Accordingly, the arrangement of the microwave oven M of the present invention in which the distance l1+l2 between the inner surface of the door 4 and the inner surface of the rear wall 2d of the heating cavity 3 is larger than the inner width S of the heating cavity 3 is very advantageous for further preventing the object 7 and the spit 35 from contacting the inner surface of the glass plate 38 of the door 4 as well as for imparting optimum stability to the microwave oven itself.

Referring also to FIG. 8, in the microwave oven M of the present invention, the central $O_1$-$O_1'$ of the magnetron assembly 16 located at approximately the central portion of the top wall 2c for the heating cavity 3 is offset to a certain extent from the rotational center O-O' of the rotary table 19 as shown in FIGS. 5 and 6. Meanwhile, the disposition of the central axis $O_1$-$O_1'$ of the magnetron assembly 16 close to the center of the top wall 2c of the heating cavity 3 results in approximately symmetrical distribution of heating strength with respect to the width and depth of the heating cavity 3 as is seen from FIG. 8, in which hatched portions are particularly subjected to strong heating. In the above arrangement, the offsetting of the rotational center O-O' of the rotary table 19 from the central axis $O_1$-$O_1'$ of the magnetron assembly 16 is particularly advantageous in that the objects to be heated placed on the rotary table 19 at any given positions, for example, on radii r1 and r2 from the rotational center O-O' pass more evenly through the hatched strongly heated portions and other less strongly heated portions therebetween, whereby far the more uniform heating of the objects is achieved.

Furthermore, since a heating strength distribution which is symmetrical and regular with respect to the width and depth of the heating cavity 3 is obtained by arranging the central axis $O_1$-$O_1'$ of the magnetron assembly 16 so as to be located approximately in the central portion of the top wall 2*c* and consequently of the heating cavity 3, sufficiently favourable heating can be achieved even without rotating the rotary table 19 depending on the kinds of the object 7 to be cooked. Accordingly, by making the rotary table 19 detachable from the heating cavity 3 according to the kinds of the object 7 to be heated, a larger space can be provided in the heating cavity 3 without affecting the uniformity in heating.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as included therein.

What is claimed is:

1. A high frequency microwave oven which comprises an oven defining structure, walls within said oven defining structure defining a heating cavity for accomodating therein an object to be heated and having an access opening at one lateral side of the heating cavity, door means having an observation window therein and an electric wave shielding member and transparent plate members on opposite sides thereof forming the inner and outer surfaces of said door means and mounted on said oven defining structure, said door means selectively opening and closing said access opening, means in said oven defining structure for supplying high frequency energy into said heating cavity, and rotary table means rotatably disposed within said heating cavity for carrying the object to be heated thereon and being rotatable about a rotational center thereof, said rotational center of said rotary table being offset toward the rear wall of said heating cavity which is diametrically opposite said access opening relative to said rotational center, the distance of such offset being a portion of the distance between the inner surface of said door and the rear wall of the heating cavity, the distance from said rotational center of said rotary table means to the inner surface of said door means being greater than the distance from said rotational center to the rear wall of said heating cavity.

2. A high frequency microwave oven as claimed in claim 1, wherein said high frequency energy supplying means has the center thereof disposed at approximately the central portion of the top wall of said heating cavity and comprises means for producing a pattern of electromagnetic energy having more intense and less intense portions in a uniformly distributed arrangement with the center at the center of the energy supplying means, said rotational center of said rotary table means being offset from the central axis of said high frequency energy supplying means a sufficient distance for causing the object to be heated to be subjected to a more even heating within said heating cavity during rotation of said rotary table means.

* * * * *